US008505726B1

(12) United States Patent
Woog

(10) Patent No.: US 8,505,726 B1
(45) Date of Patent: Aug. 13, 2013

(54) COOLER FOR BEVERAGE CONTAINERS

(71) Applicant: Gunter Woog, West Bend, WI (US)

(72) Inventor: Gunter Woog, West Bend, WI (US)

( * ) Notice: Subject to any disclaimer, the term of this patent is extended or adjusted under 35 U.S.C. 154(b) by 0 days.

(21) Appl. No.: 13/648,324

(22) Filed: Oct. 10, 2012

(51) Int. Cl.
*B65D 85/20* (2006.01)

(52) U.S. Cl.
USPC ..... 206/457; 220/592.16; 62/457.5

(58) Field of Classification Search
USPC .... 206/457, 139, 427, 429, 443; 220/592.01, 220/592.16, 592.2, 592.25, 515, 513, 507, 220/509; 62/457.1–457.8
See application file for complete search history.

(56) References Cited

U.S. PATENT DOCUMENTS

| | | | | | |
|---|---|---|---|---|---|
| 404,677 | A * | 6/1889 | Blix | 224/197 |
| 2,501,772 | A * | 3/1950 | Guard | 220/592.16 |
| 3,023,891 | A * | 3/1962 | Sutter | 206/488 |
| 3,428,235 | A * | 2/1969 | Randazzo | 206/427 |
| 3,828,926 | A * | 8/1974 | Rossi | 206/427 |
| 4,266,407 | A * | 5/1981 | Gibson | 62/371 |
| 4,571,740 | A * | 2/1986 | Kirby et al. | 455/344 |
| 4,580,412 | A * | 4/1986 | Wells | 62/372 |
| 4,628,705 | A * | 12/1986 | Nave | 62/457.5 |
| 4,704,875 | A * | 11/1987 | Kieler | 62/372 |
| 4,747,274 | A * | 5/1988 | Duemmig-Zitzmann | 62/371 |
| 4,789,081 | A * | 12/1988 | Mobbs | 221/281 |
| 4,832,196 | A * | 5/1989 | Butler | 206/391 |
| 4,836,367 | A * | 6/1989 | Golkar | 206/200 |
| 4,856,652 | A * | 8/1989 | Bowland | 206/223 |
| 4,883,169 | A * | 11/1989 | Flanagan, Jr. | 206/170 |
| 4,899,553 | A * | 2/1990 | Drummond, III | 62/372 |
| 4,901,870 | A * | 2/1990 | Wright et al. | 211/59.4 |
| 5,170,934 | A * | 12/1992 | Lemoine | 229/101 |
| 5,558,224 | A * | 9/1996 | Fogle | 206/427 |
| 5,687,838 | A * | 11/1997 | Bakx | 206/147 |
| 5,758,513 | A * | 6/1998 | Smith | 62/457.5 |
| 6,058,733 | A * | 5/2000 | Morgan | 62/389 |
| 6,347,706 | B1 * | 2/2002 | D'Ambrosio | 206/541 |
| 6,360,558 | B1 * | 3/2002 | Woog | 62/457.5 |
| 6,481,014 | B1 * | 11/2002 | Banks et al. | 220/592.17 |
| D474,686 | S * | 5/2003 | Woog | D7/605 |
| 6,598,419 | B1 * | 7/2003 | Tago | 62/457.5 |
| D497,290 | S * | 10/2004 | Porshia | D7/605 |
| 6,802,802 | B2 * | 10/2004 | Woog | 493/129 |
| 7,097,034 | B2 * | 8/2006 | Woog | 206/427 |
| 7,168,263 | B1 * | 1/2007 | Zenner | 62/457.1 |
| 7,269,970 | B2 * | 9/2007 | Robertson | 62/457.5 |
| D561,609 | S * | 2/2008 | McMorris | D9/739 |
| 7,588,277 | B2 * | 9/2009 | Crown | 294/146 |
| D638,310 | S * | 5/2011 | Kennedy | D9/751 |
| D644,859 | S * | 9/2011 | Buckles et al. | D6/491 |
| 8,057,207 | B2 * | 11/2011 | Zorovich et al. | 425/117 |
| 8,161,756 | B2 * | 4/2012 | Kutta et al. | 62/63 |
| 8,230,697 | B2 * | 7/2012 | Lavallee | 62/457.7 |

(Continued)

*Primary Examiner* — J. Gregory Pickett
*Assistant Examiner* — James Way
(74) *Attorney, Agent, or Firm* — Donald J. Ersler

(57) ABSTRACT

A cooler for beverage containers preferably includes a cooler container, a cooler lid and a cooler cover. The cooler container, cooler lid and cooler cover are shaped to resemble a V-type engine. The cooler container includes an outer surface wall, which has a substantially consistent thickness. An inner surface of the outer surface wall forms a cooling cavity to accept beverage containers and ice. A pair of cylinder banks are formed on opposing sides of the cooler container and the cooler lid. At least one beverage container opening is formed through each cylinder bank to receive a beverage container. The cooler cover includes a first valve cooler cover, a manifold cooler cover and a second valve cooler cover. The cooler lid is secured to a bottom of the manifold cooler cover.

20 Claims, 6 Drawing Sheets

(56) References Cited

U.S. PATENT DOCUMENTS

| | | | | |
|---|---|---|---|---|
| 2006/0169602 | A1* | 8/2006 | Woog | 206/141 |
| 2006/0196218 | A1* | 9/2006 | Mogil et al. | 62/457.4 |
| 2006/0248918 | A1* | 11/2006 | Robertson | 62/457.5 |
| 2006/0266667 | A1* | 11/2006 | Mendenhall et al. | 206/427 |
| 2009/0026099 | A1* | 1/2009 | Robinson et al. | 206/427 |
| 2009/0229293 | A1* | 9/2009 | Kim | 62/264 |
| 2010/0126196 | A1* | 5/2010 | McCance | 62/264 |
| 2010/0307946 | A1* | 12/2010 | Berends | 206/443 |
| 2010/0310105 | A1* | 12/2010 | Davis | 381/334 |
| 2010/0326857 | A1* | 12/2010 | Abood et al. | 206/427 |
| 2011/0252824 | A1* | 10/2011 | Dallas et al. | 62/457.5 |

* cited by examiner

COOLER FOR BEVERAGE CONTAINERS

BACKGROUND OF THE INVENTION

1. Field of the Invention

The present invention relates generally to cooling beverage containers and more specifically to a cooler for beverage containers, which includes a unique structure for cooling beverage containers.

2. Discussion of the Prior Art

U.S. Pat. No. 6,360,558 to Woog discloses a combination carrier and cooler for beverage containers. U.S. Pat. No. D474,686 to Woog discloses a beverage container carrier. U.S. Pat. No. 6,802,802 to Woog discloses a beverage carrier. U.S. Pat. No. 7,097,034 to Woog discloses a carrier. However, the previously recited patents fail to disclose a cooler lid and a cooler container molded from an insulating material. The cooler container and cooler lid each include half beverage container openings for retaining a perimeter of at least two beverage containers. The half beverage container openings are formed, such that at least two opposing beverage containers are retained in a V-configuration relative to each other. The beverage containers mimic a piston in a V-type engine.

Accordingly, there is a clearly felt need in the art for a cooler for beverage containers, which includes a cooler container and cooler lid each having semi-circular slots for retaining a perimeter of at least two beverage containers; and the semi-circular slots formed, such that at least two opposing beverage containers are retained in a V-configuration relative to each other.

SUMMARY OF THE INVENTION

The present invention provides a cooler for beverage containers, which includes a unique structure for cooling beverage containers. The cooler for beverage containers preferably includes a cooler container, a cooler lid and a cooler cover. The cooler container and cooler lid are shaped to substantially resemble a V-8 engine. However, the cooler container and cooler lid may also substantially resemble V-type engine blocks which include V-2, V-4, V-6, V-10, V-12 and V-16 engine blocks. The cooler container includes an outer surface wall, which has a substantially consistent thickness. An inner surface of the outer surface wall forms a cooling cavity to accept a plurality of beverage containers and ice. A pair of cylinder banks are formed on opposing sides of the cooler container and the cooler lid. At least one beverage container opening is formed through each cylinder bank, each beverage container opening is sized to receive a beverage container. An inner perimeter opening is formed in a top of the cooler container.

The cooler lid includes an outer perimeter. The outer perimeter includes a pair of opposed end walls. A lid cavity is formed in a bottom of the cooler lid. An air cleaner projection is preferably formed on a top of the cooler lid. A plurality of intake runner projections extend from the air cleaner projection and substantially extend to each beverage container opening. The cooler cover includes a first valve cooler cover, a manifold cooler cover and a second valve cooler cover. The cooler cover is fabricated from a clear or translucent plastic. The first valve cooler cover is pivotally retained on one side of the manifold cooler cover and the second valve cooler cover is pivotally retained on an opposing side of the manifold cooler cover. The cooler lid is secured to a bottom of the manifold cooler cover.

Accordingly, it is an object of the present invention to provide a cooler for beverage containers, which includes a cooler container and cooler lid each having half beverage container openings for retaining a perimeter of at least two beverage containers.

Finally, it is another object of the present invention to provide a cooler for beverage containers, which also includes retaining at least two beverage containers in a V-configuration relative to each other.

These and additional objects, advantages, features and benefits of the present invention will become apparent from the following specification.

DETAILED DESCRIPTION OF THE PREFERRED EMBODIMENTS

Figure 1:
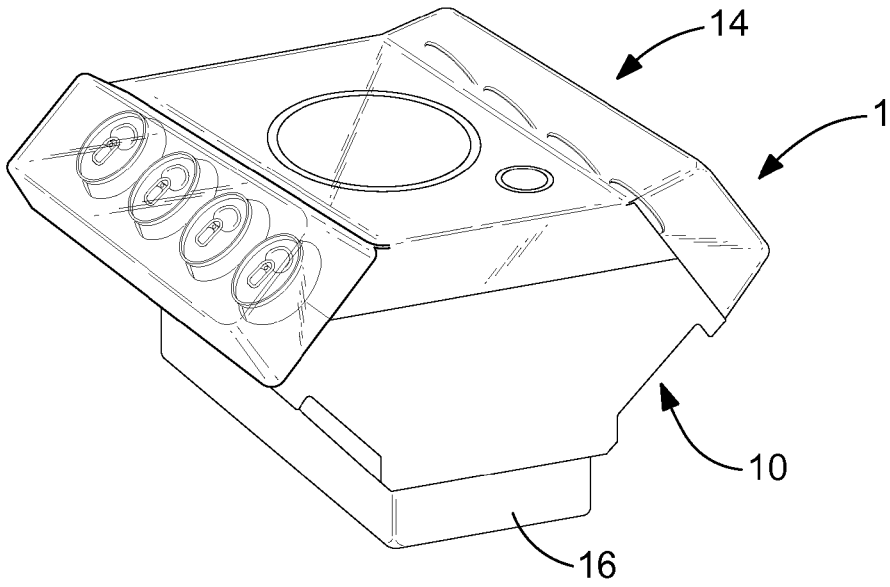
FIG. 1 is a perspective view of a cooler for beverage containers with a cooler cover in accordance with the present invention.
Figure 2:
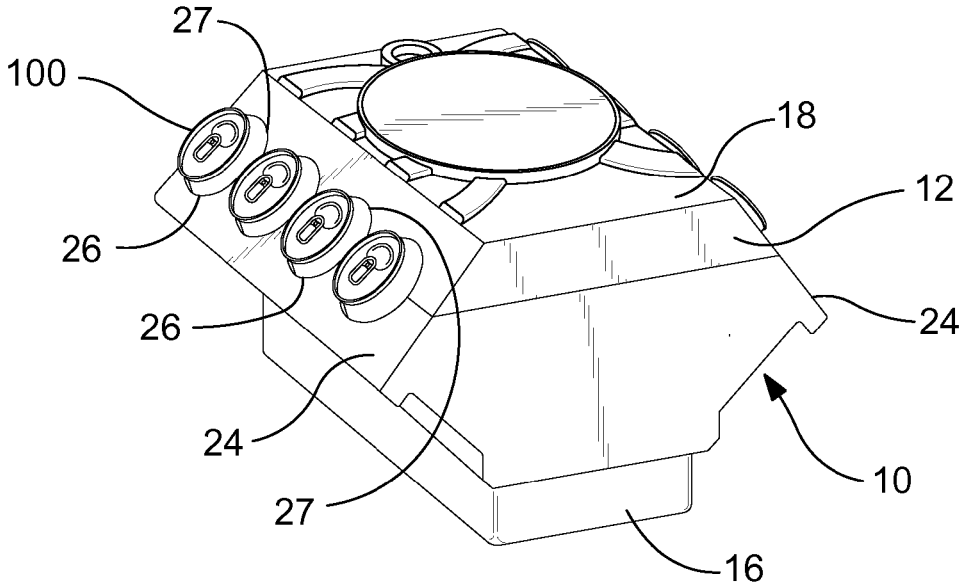
FIG. 2 is a perspective view of a cooler for beverage containers with a cooler cover removed in accordance with the present invention.
Figure 3:
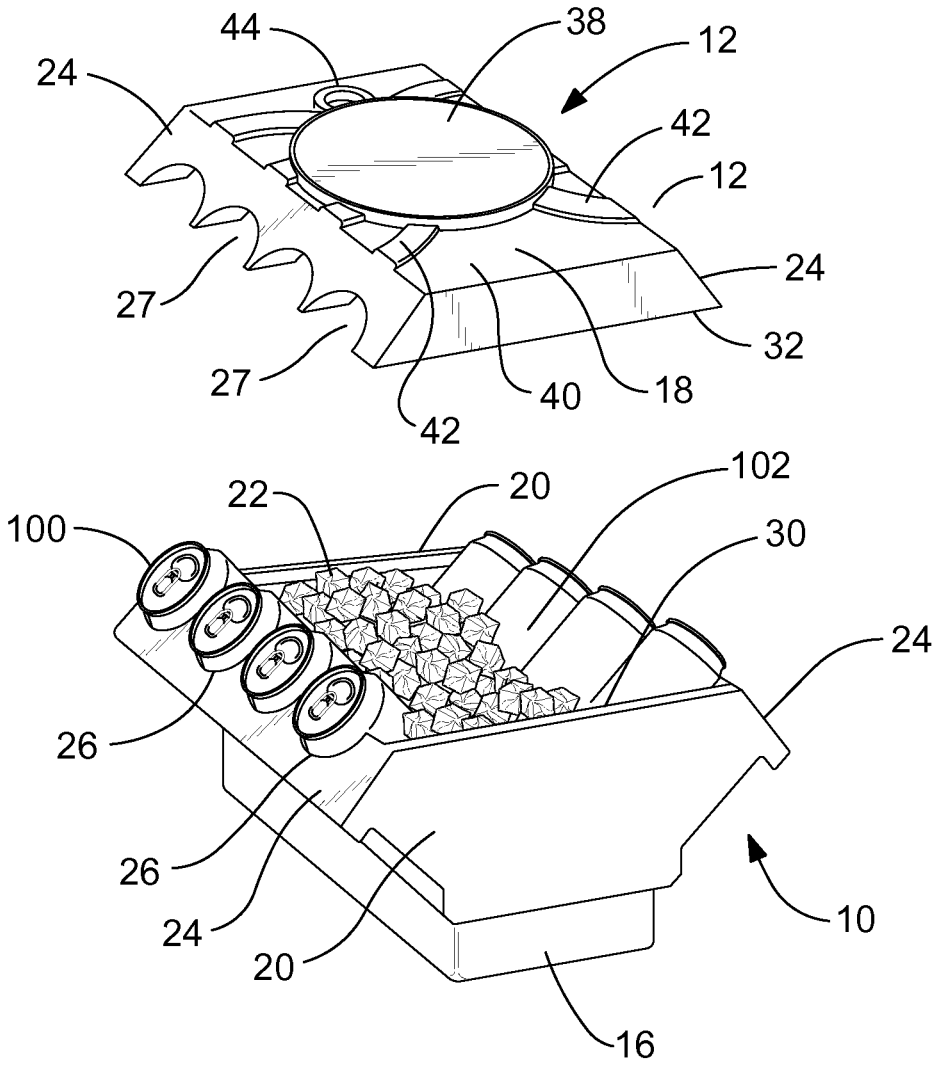
FIG. 3 is an exploded perspective view of a cooler for beverage containers with a cooler lid removed and without a cooler cover in accordance with the present invention.
Figure 4:
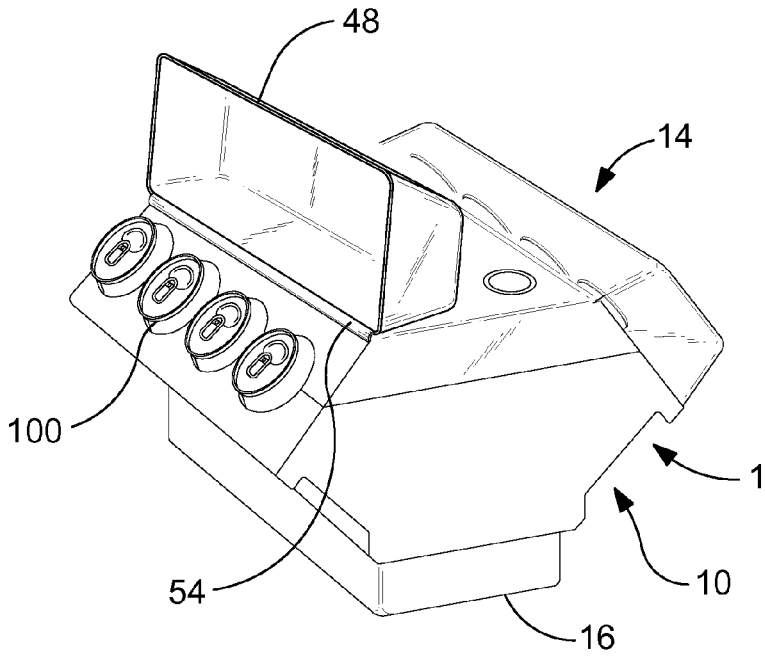
FIG. 4 is a perspective view of a cooler for beverage containers with a cooler cover and one valve cooler cover lifted-up in accordance with the present invention.

With reference now to the drawings, and particularly to FIG. 1, there is shown a perspective view of a cooler for beverage containers 1. With reference to FIGS. 2-10, the cooler for beverage containers 1 preferably includes a cooler container 10, a cooler lid 12 and a cooler cover 14. The cooler container 10 and cooler lid 12 are shaped to substantially resemble a V-8 engine with an oil pan projection 16 extending from a bottom of the cooler container 10 and an intake manifold 18 extending from a top of the cooler lid 12. However, the cooler container 10 and cooler lid 12 may also substantially resemble V-type engine blocks which include V-2, V-4, V-6, V-10, V-12 and V-16 engine blocks. The cooler container 10 and the cooler lid 12 are preferably fabricated from a molded material having insulating properties, such as styrofoam.

The cooler container 12 includes an outer surface wall 20, which preferably has a substantially consistent thickness which follows an outer shape of the cooler container 10. An inner surface of the outer surface wall 20 forms a cooling cavity 22 to accept beverage containers 100 and ice 102. A pair of cylinder banks 24 are formed on opposing sides of the cooler container 10 and the cooler lid 12. At least one half beverage container opening 26 is formed through each cylinder bank 24 in the cooler container 10. Each half beverage container opening 26 is sized to receive a portion of a beverage container 100. At least one half beverage container opening 27 is formed through each cylinder bank 24 in the cooler lid 12. Each half beverage container opening 27 is sized to receive a portion of a beverage container 100. The half beverage container openings 26, 27 preferably have a semi-circular shape, but other shapes could be used.

A top of each cylinder bank 24 forms an acute angle "A" with a top of the cooler container 10 and cooler lid 12. Centerlines 28 of two opposing semi-circular openings 26, 27 intersect each other. The intersection of the two opposing centerlines 28 may form acute or obtuse angles. Substantially one half of each cylinder bank 24 is formed on one of two opposing top edges of the cooler container 10 and substantially the other half of each cylinder bank 24 is formed one of two opposing sides of the cooler lid 12. An inner perimeter opening 30 is formed in a top of the cooler container 12.

The cooler lid 12 preferably includes an outer perimeter 32. The outer perimeter 32 includes a pair of opposed end walls 34, 35. A lid cavity 36 is formed in a bottom of the cooler lid 12. An air cleaner projection 38 is preferably formed on a top 40 of the cooler lid 12. A plurality of intake runner projections 42 extend from the air cleaner projection 38 and extend substantially to each half beverage container opening 27. A sound cavity 44 may be formed in the top 40 of the cooler lid 10, adjacent the air cleaner projection 38. The sound cavity 44 is sized to receive a sound module 46. The sound module 46 includes an audio speaker, amplifier, sound chip, an electrical switch and a battery. Sound modules are well known in the art and need not be explained in further detail. The sound chip preferably includes a sound recording of a V-type engine. The sound chip plays the recording, when the electrical switch is activated. However, the sound chip may have any other suitable recording, which is programmed specifically for each application, such as a car or a beverage product. The recording time on the sound chip is preferably expandable for a length of the recording.

Figure 5:
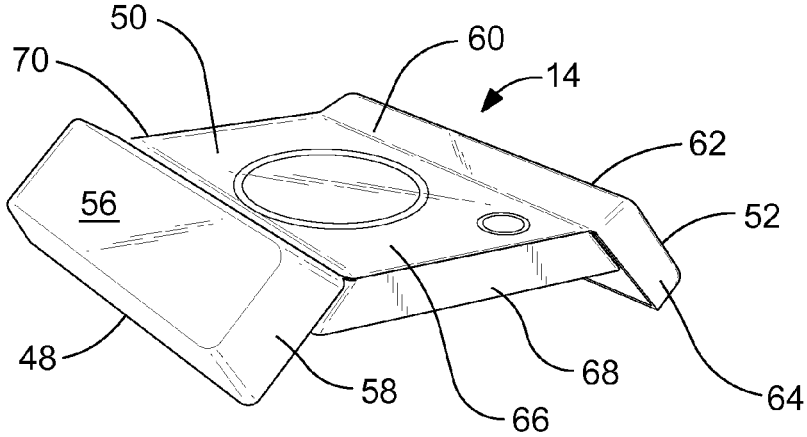
FIG. 5 is a perspective view of a cooler cover of a cooler for beverage containers in accordance with the present invention.
Figure 6:
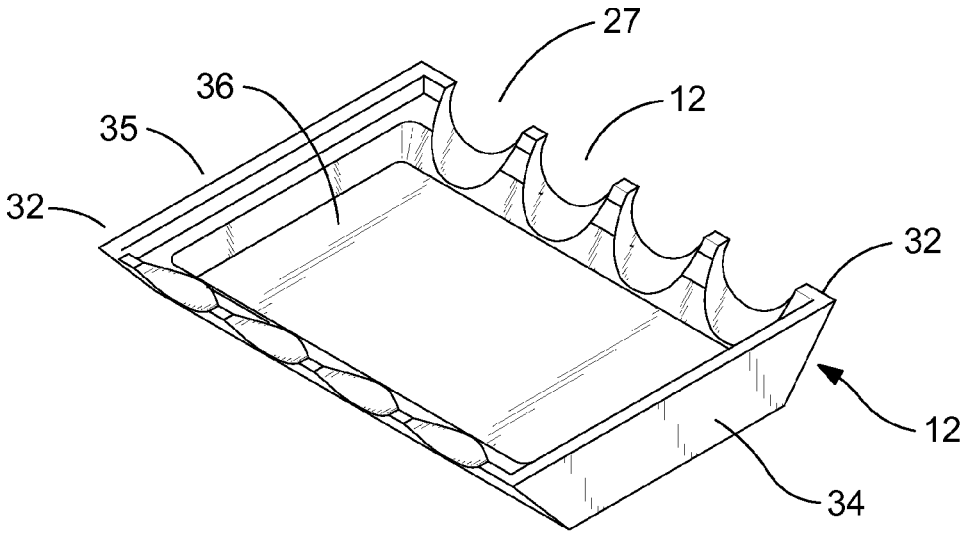
FIG. 6 is a bottom perspective view of a cooler lid of a cooler for beverage containers in accordance with the present invention.
Figure 7:
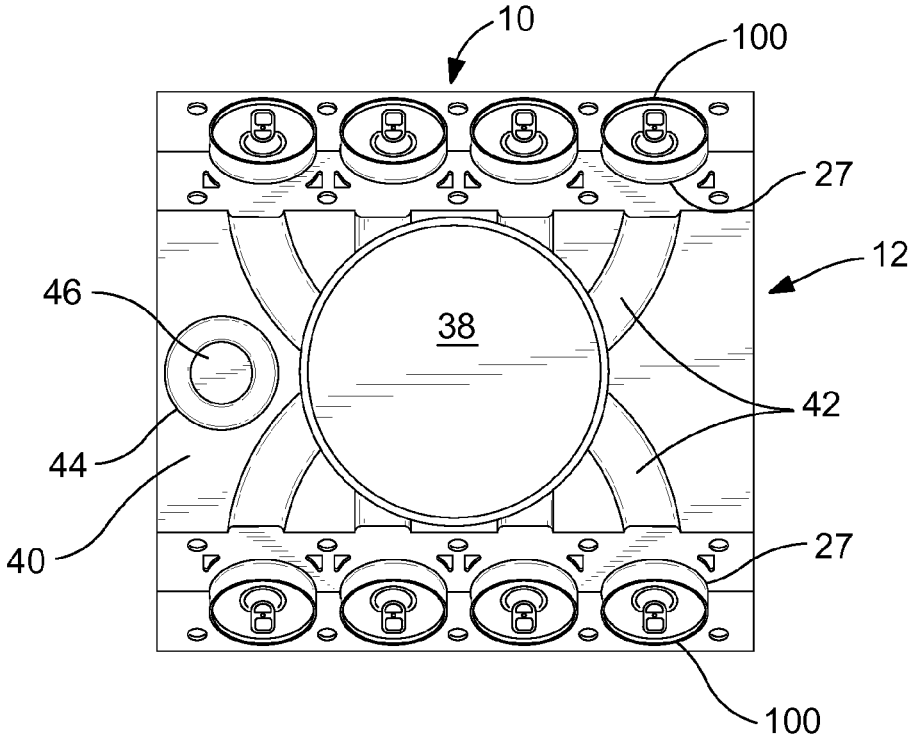
FIG. 7 is a top view of a cooler for beverage containers without a cooler cover in accordance with the present invention.
Figure 8:
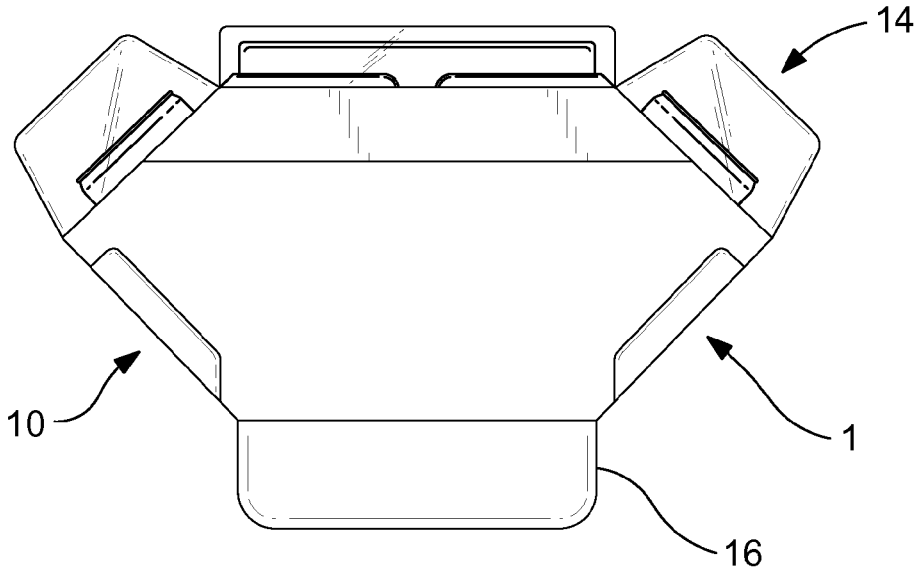
FIG. 8 is an end view of a cooler for beverage containers with a cooler cover in accordance with the present invention.
Figure 9:
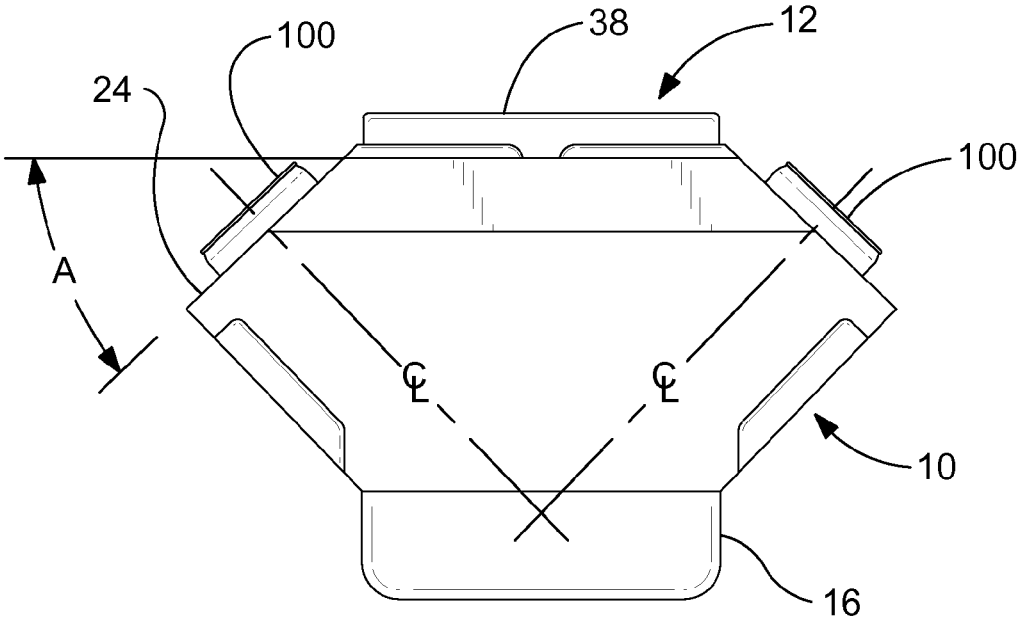
FIG. 9 is an end view of a cooler for beverage containers with a cooler cover removed in accordance with the present invention.
Figure 10:
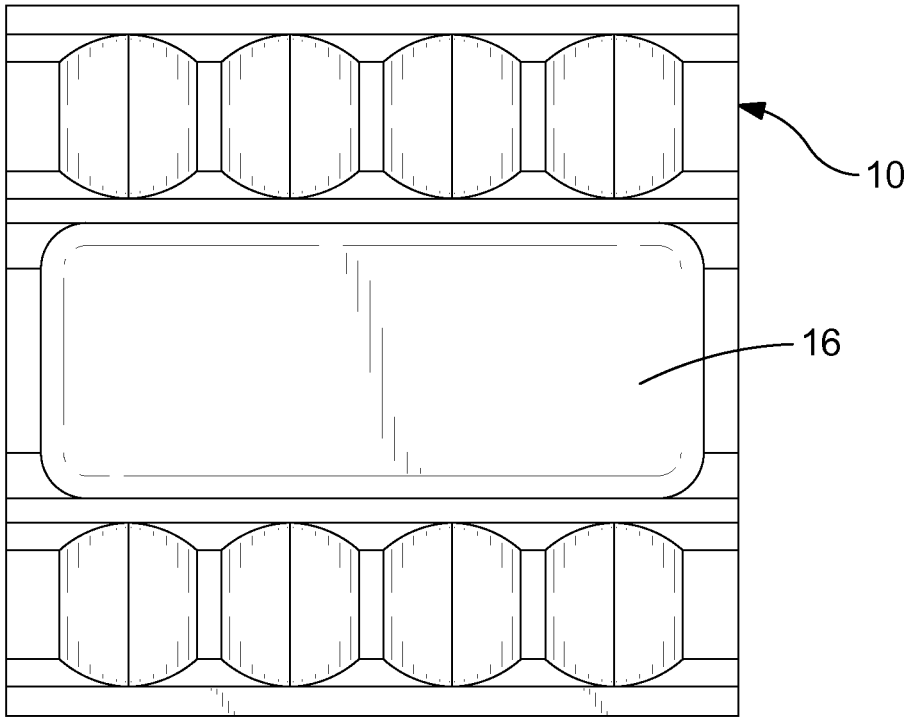
FIG. 10 is a bottom view of a cooler for beverage containers with a cooler cover removed in accordance with the present invention.

With reference to FIG. 5, the cooler cover 14 includes a first valve cooler cover 48, a manifold cooler cover 50 and a second valve cooler cover 52. The cooler cover 14 is fabricated from a clear or translucent plastic. The first valve cooler cover 48 is pivotally retained on one side of the manifold cooler cover 50 preferably with a first living hinge 54. The first valve cooler cover 48 includes a first top surface 56 and a first peripheral wall 58, which extends downward from the top surface 56. The second valve cooler cover 52 is pivotally retained on an opposing side of the manifold cooler cover 50 preferably with a second living hinge 60. The second valve cooler cover 52 includes a second top surface 62 and a second peripheral wall 64, which extends downward from the second top surface 62.

The manifold cooler cover 50 preferably includes a manifold top surface 66, a first end wall 68 and a second end wall 70. The first end wall 68 extends downward from a first end of the manifold top surface 66 and the second end wall 70 extends downward from a second end of the manifold top surface 66. The cooler lid 12 is secured to a bottom of the manifold top surface 66. A single beverage container 100 is inserted into each beverage container opening 26, 27 in the cooling container 10 and the cooling lid 12. After all the beverage containers 100 are inserted into the beverage container openings 26, 27 additional beverage containers 100 may be inserted into the cooling cavity 22. Ice 102 or ice water is placed over the plurality of beverage containers 100. Then, the cooling lid 12 or the cooling cover 14 is placed over the cooling container 10. To remove one of the beverage containers 100 from one of the beverage container openings 26, one of the valve cooler covers 48, 52 is lifted. The cooling lid 12 or the cooling cover 14 is removed to retrieve a beverage container 100 from the cooling cavity 22.

While particular embodiments of the invention have been shown and described, it will be obvious to those skilled in the art that changes and modifications may be made without departing from the invention in its broader aspects, and therefore, the aim in the appended claims is to cooler cover all such changes and modifications as fall within the true spirit and scope of the invention.

I claim:

1. A cooler for beverage containers comprising:

a cooler container having an outer shape that substantially resembles a V-type engine block, said cooler container includes a top and a bottom, said cooler container includes a cooling cavity formed therein;

a cooler lid includes a top and a bottom, a bottom of said cooler lid is placed on said cooling container, said cooler lid covers said cooling cavity; and a pair of opposed cylinder banks are formed as a portion of said cooler container and said cooler lid, at least one beverage container opening is formed in each one of said pair of opposed cylinder banks to receive a beverage container, a portion of said at least one beverage container opening is formed in each of said cooler container and said cooler lid, wherein the beverage container being viewable within said at least one beverage container opening, when said cooler container and said cooler lid are assembled.

2. The cooler for beverage containers of claim 1, further comprising:

a cooler cover includes a first valve cover, a manifold cover and a second valve cover, said first valve cover is pivotally retained by one side of said manifold cover, said second valve cover is pivotally retained by an opposing side of said manifold cover, wherein said valve cover pivots relative to said manifold cover when the other side of said valve cover is lifted.

3. The cooler for beverage containers of claim 2 wherein:

said cooler lid is attached to a bottom of said manifold cover.

4. The cooler for beverage containers of claim 1 wherein:

a bottom intersection of a centerline of each opposing beverage container opening of said at least one beverage container opening forming a V-shape.

5. The cooler for beverage containers of claim 1, further comprising:

an oil pan projection extends from said bottom of said cooler container.

6. The cooler for beverage containers of claim 1, further comprising:

an air cleaner projection is formed on a top of said cooler lid.

7. The cooler for beverage containers of claim 1, further comprising:

a sound module is retained in said cooler lid to provide a recording of a car or a beverage product.

8. A cooler for beverage containers comprising:

a cooler container having an outer shape that substantially resembles a V-type engine block, said cooler container includes a cooling cavity formed therein;

a cooler lid includes a top and a bottom, a lid cavity is formed in said bottom of said cooler lid, a bottom of said cooler lid is placed on said cooling container, said cooler lid covers said cooling cavity; and;

a pair of opposed cylinder banks are formed as a portion of said cooler container and said cooler lid, at least one beverage container opening is formed in each one of said pair of opposed cylinder banks to receive a beverage container, a portion of said at least one beverage container opening is formed in each of said cooler container and said cooler lid, wherein the beverage container being viewable within said at least one beverage container opening, when said cooler container and said cooler lid are assembled.

9. The cooler for beverage containers of claim 8, further comprising:

a cooler cover includes a first valve cover, a manifold cover and a second valve cover, said first valve cover is pivotally retained by one side of said manifold cover, said second valve cover is pivotally retained by an opposing side of said manifold cover, wherein said valve cover pivots relative to said manifold cover when the other side of said valve cover is lifted.

10. The cooler for beverage containers of claim 9 wherein:

said cooler lid is attached to a bottom of said manifold cover.

11. The cooler for beverage containers of claim 8 wherein:

a bottom intersection of a centerline of each opposing beverage container opening of said at least one beverage container opening forming a V-shape.

12. The cooler for beverage containers of claim 8, further comprising:

an oil pan projection extends from said bottom of said cooler container.

13. The cooler for beverage containers of claim 8, further comprising:

an air cleaner projection is formed on a top of said cooler lid.

14. The cooler for beverage containers of claim 8, further comprising:

a sound module is retained in said cooler lid to provide a recording of a car or a beverage product.

15. A cooler for beverage containers comprising:

a cooler container having an outer shape that substantially resembles a V-type engine block, said cooler container includes a cooling cavity formed therein;

a cooler lid includes a top and a bottom, a bottom of said cooler lid is placed on said cooling container, said cooler lid covers said cooling cavity; and;

a pair of opposed cylinder banks are formed as a portion of said cooler container and said cooler lid, at least one beverage container opening is formed in each one of said pair of opposed cylinder banks to receive a beverage container, at least one of said at least one beverage container opening has a substantially circular shape, a portion of said at least one beverage container opening is formed in each of said cooler container and said cooler lid, wherein the beverage container being viewable within said at least one beverage container opening, when said cooler container and said cooler lid are assembled.

16. The cooler for beverage containers of claim 15, further comprising:

a cooler cover includes a first valve cover, a manifold cover and a second valve cover, said first valve cover is pivotally retained by one side of said manifold cover, said second valve cover is pivotally retained by an opposing side of said manifold cover, wherein said valve cover pivots relative to said manifold cover when the other side of said valve cover is lifted.

17. The cooler for beverage containers of claim 16 wherein:

said cooler lid is attached to a bottom of said manifold cover.

18. The cooler for beverage containers of claim 15 wherein:

a bottom intersection of a centerline of each opposing beverage container opening of said at least one beverage container opening forming a V-shape.

19. The cooler for beverage containers of claim 15, further comprising:

an oil pan projection extends from said bottom of said cooler container.

20. The cooler for beverage containers of claim 15, further comprising:

an air cleaner projection is formed on a top of said cooler lid.

* * * * *